US006017205A

United States Patent [19]

Weatherston et al.

[11] Patent Number: 6,017,205

[45] Date of Patent: Jan. 25, 2000

[54] SCROLL COMPRESSOR

[75] Inventors: Roger C. Weatherston, Williamsville, N.Y.; Kenneth L. Feathers, West Milton, Ohio; James F. Fogt, Sidney, Ohio; Jean-Luc Caillat, Dayton, Ohio

[73] Assignee: Copeland Corporation, Sidney, Ohio

[21] Appl. No.: 08/693,594

[22] Filed: Aug. 2, 1996

[51] Int. Cl.[7] ..... F01C 1/02

[52] U.S. Cl. ..... 418/55.6; 418/89; 418/99; 418/94; 418/85; 417/13; 184/6

[58] Field of Search ..... 417/32, 13; 418/55.1, 418/55.6, 85, 94, 99, 89; 184/6.16

[56] References Cited

U.S. PATENT DOCUMENTS

| | | | |
|---|---|---|---|
| 4,343,599 | 8/1982 | Kousokabe . | |
| 4,676,075 | 6/1987 | Shibayashi . | |
| 4,696,630 | 9/1987 | Sakata et al. | 418/55 |
| 4,762,477 | 8/1988 | Hayano et al. | 418/1 |
| 4,877,382 | 10/1989 | Caillat et al. | 418/55 |
| 5,102,316 | 4/1992 | Caillat et al. | 418/55.5 |
| 5,156,539 | 10/1992 | Anderson et al. | 418/55.4 |
| 5,217,360 | 6/1993 | Kawahara et al. . | |
| 5,256,042 | 10/1993 | McCullough et al. . | |
| 5,263,822 | 11/1993 | Fujio . | |
| 5,320,506 | 6/1994 | Fogt | 418/55.3 |
| 5,320,507 | 6/1994 | Monnier et al. | 418/55.6 |
| 5,421,708 | 6/1995 | Utter et al. | 418/55.6 |
| 5,527,158 | 6/1996 | Ramsey et al. | 417/32 |
| 5,564,280 | 10/1996 | Schilling et al. | 62/84 |
| 5,593,294 | 1/1997 | Houghby et al. | 418/55.1 |
| 5,640,854 | 6/1997 | Fogy et al. | 62/197 |
| 5,660,539 | 8/1997 | Matsunaga et al. | 418/55.6 |
| 5,667,371 | 9/1997 | Prenger et al. | 418/55.1 |
| 5,683,236 | 11/1997 | Harrison et al. | 418/55.1 |
| 5,690,475 | 11/1997 | Yamada et al. | 417/32 |
| 5,707,210 | 1/1998 | Ramsey et al. | 417/32 |
| 5,716,202 | 2/1998 | Koyama et al. | 418/55.6 |
| 5,745,992 | 5/1998 | Caillat et al. | 29/888.022 |

FOREIGN PATENT DOCUMENTS

| | | |
|---|---|---|
| 61-40483 | 2/1986 | Japan . |
| 61-268896 | 11/1986 | Japan . |
| 1-32089 | 2/1989 | Japan . |
| 03271583 | 12/1991 | Japan . |

*Primary Examiner*—Charles G. Freay
*Assistant Examiner*—Ehud Gartenberg
*Attorney, Agent, or Firm*—Harness, Dickey & Pierce, P.L.C.

[57] ABSTRACT

A scroll-type compressor is disclosed which includes both a high pressure lubricant sump and a low pressure lubricant sump. Lubricant from the low pressure lubricant sump is supplied to the various bearing, thrust surfaces and other moving parts to lubricate same and a portion thereof is also supplied to the suction gas entering the compressor to replenish the lubricant in the high pressure sump. An oil separator is disposed in a discharge chamber to separate entrained oil from the compressed gas. A level control assembly is also provided in the discharge chamber and serves to return excessive accumulations of oil from the high pressure sump to the low pressure sump. In one embodiment, the compressor is specifically designed for compression of helium while in a second embodiment, the compressor is adapted for use as an air compressor.

85 Claims, 6 Drawing Sheets

SCROLL COMPRESSOR

BACKGROUND AND SUMMARY OF THE INVENTION

The present invention relates generally to a scroll-type machine and more specifically to a scroll-type machine specifically adapted for use in either cryogenic applications utilizing helium as the refrigerant or as an air compressor.

The use of helium as a refrigerant is common in very low temperature applications. However, the cyclic compression of helium presents very unique problems with respect to compressor design because of the high temperatures encountered during the compression process; typically more than twice the temperature rise encountered with the use of more conventional refrigerants. In order to prevent possible damage to the compressor from these high temperatures, it is necessary to provide increased cooling thereto such as by circulating large quantities of oil through the compressor.

Compression of air also results in substantial temperature increases and in addition thereto presents problems of contamination because the air compression system is an open system as opposed to the closed systems generally used in refrigeration applications. Because an air compressor is drawing its suction gas from the atmosphere, various particulate matter as well as potentially corrosive vapor and gaseous contaminants may be cycled through the compressor. Accordingly, in these types of compressors, it is also desirable to circulate substantial quantities of lubricant through the compressor as well.

The present invention comprises a scroll compressor, which is specifically adapted for use in the compression of both helium and air which in addition to the conventional low pressure oil sump, also includes a second high pressure oil sump in the discharge chamber. The oil from the low pressure oil sump is circulated to the bearings and other moving parts in a manner similar to that of conventional scroll compressors. However, oil from the high pressure oil sump is directed through an external heat exchanger for cooling and then injected into the compression pockets to aid in cooling of the compressor as well as to assist in sealing of the wraps and lubricating same. An oil separator is provided in the discharge chamber of the compressor to remove at least a portion of the injected oil from the compressed gas to thereby replenish the high pressure oil sump. A unique level control arrangement is also provided to prevent excess accumulation of oil in the high pressure oil sump. Relatively large volumes of oil must be circulated in this manner to prevent overheating of the compressor during operation as well as to aid in lubrication thereof. It should be noted that in such cryogenic applications it is exceedingly important that the refrigerant (i.e. helium) be virtually oil free and hence it is common for such systems to employ multiple external oil separators to ensure complete removal of the oil injected during the compression process. This is also true in many applications in which compressed air is utilized.

Additional advantages and features of the present invention will become apparent from the subsequent description and the appended claims taken in conjunction with the accompanying drawings.

BRIEF DESCRIPTION OF THE DRAWINGS

FIG. 6 is a schematic view illustrating the refrigeration circuit incorporating the compressor of FIG. 1;

DESCRIPTION OF THE PREFERRED EMBODIMENTS

Figure 1:
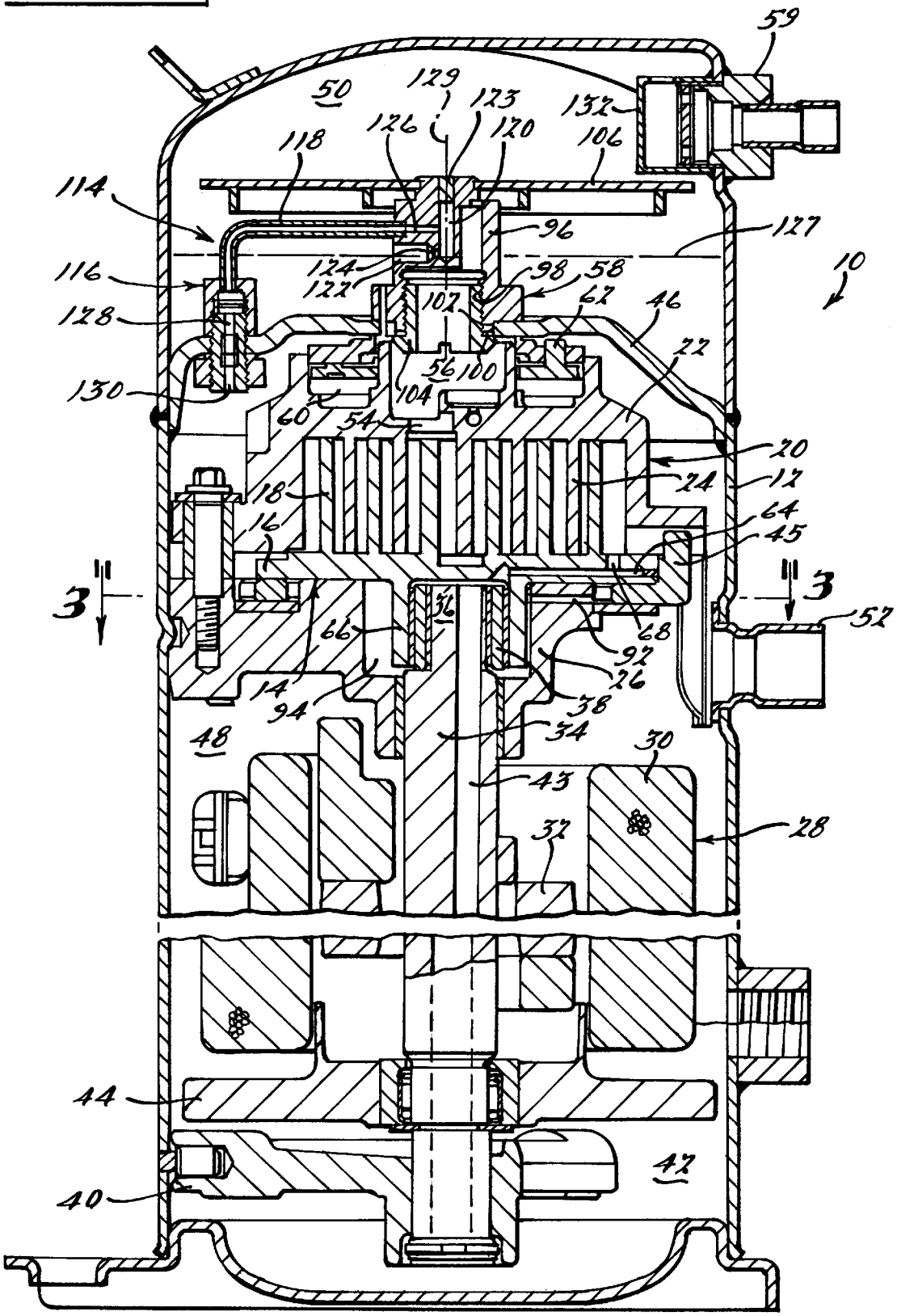
FIG. 1 is a section view of a hermetic scroll-type compressor in accordance with the present invention, the section being taken along an axially extending radial plane.

Referring now to the drawings and more specifically to FIG. 1, there is shown a hermetic compressor of the scroll-type indicated generally at 10 in accordance with the present invention. Compressor 10 includes an outer shell 12 within which is disposed a compressor assembly including an orbiting scroll member 14 having an end plate 16 from which a spiral wrap 18 extends, a non-orbiting scroll member 20 having an end plate 22 from which a spiral wrap 24 extends and a main bearing housing 26 supportingly secured to outer shell 12. Main bearing housing 26 supports orbiting scroll member 14 and non-orbiting scroll member 20 is axially movably secured thereto with respective wraps 18 and 24 positioned in meshing engagement such that as orbiting scroll member 14 orbits, the wraps will defame moving fluid pockets that decrease in size as they move toward the center of the scroll members.

A driving motor 28 is also provided in the lower portion of shell 12 including a stator 30 supported by shell 12 and a rotor 32 secured to and drivingly connected to drive shaft 34. Drive shaft 34 is drivingly connected to orbiting scroll member 14 via eccentric pin 36 and drive bushing 38 and is rotatably supported by upper bearing housing 26 and a lower bearing housing 40 which is also secured to shell 12. The lower end of drive shaft 34 extends into an oil sump 42 provided in the bottom of shell 12. A reverse rotation prevention and lower counterweight shield assembly 44 is also supported on drive shaft 34 between lower bearing 40 and motor assembly 28 and serves to restrict reverse rotation of the compressor on shut down as well as to restrict flow of oil to the area around the lower end of the rotor. In order to prevent orbiting scroll member 14 from rotating relative to non-orbiting scroll member 20, an Oldham coupling 45 is provided being supported on main bearing housing 26 and interconnecting with both orbiting scroll member 14 and non-orbiting scroll member 20.

In order to supply lubricant from oil sump 42 to the bearings and thrust surfaces, an oil pump is provided in the lower end of drive shaft 34 which serves to direct oil axially upwardly through an eccentric axially extending passage 43 in drive shaft 34. Radial passages may be provided to supply lubricant to the main bearing and/or lower bearing and a portion of the oil will be discharged from the top of eccentric pin 36 to lubricate the interface with drive bushing 38 and the interface between drive bushing 38 and orbiting scroll member 14.

A partition or muffler plate 46 is also provided extending across the interior of shell 12 and is sealingly secured thereto around its periphery. Muffler plate 46 serves to divide the interior of shell 12 into a lower suction chamber 48 and an upper discharge chamber 50.

In operation, suction gas will be drawn into suction chamber 48 of compressor 10 through suction inlet 52 and into the moving fluid pockets defined by scroll wraps 18 and 24 and end plates 16 and 22. As orbiting scroll member 14 orbits with respect to non-orbiting scroll member 20, the fluid pockets will move inwardly decreasing in size and thereby compressing the fluid. The compressed fluid will be discharged into discharge chamber 50 through discharge port 54 and passage 56 provided in non-orbiting scroll member 20 and discharge fitting assembly 58 secured to muffler plate 46. The compressed fluid then exits compressor 10 through discharge outlet 59. In order to maintain axially movable non-orbiting scroll member 20 in axial sealing engagement with orbiting scroll member 14, a pressure biasing chamber 60 is provided in the upper surface of non-orbiting scroll member 20. A floating seal 62 is positioned within chamber 60 and cooperates with muffler plate 46 to prevent leakage of discharge gas flowing into discharge chamber 50 from discharge port 54. Biasing chamber 60 is pressurized by fluid at intermediate pressure supplied from the fluid pockets under compression via passages (not shown) in non-orbiting scroll 20.

With the exception of discharge fitting 58, compressor 10 as thus far described is similar to and incorporates features described in greater detail in assignee's patents numbers 4,877,382; 5,156,539; 5,102,316; 5,320,506; and 5,320,507 the disclosures of which are hereby incorporated by reference.

As noted above, compressor 10 is specifically adapted for use with helium as a refrigerant. Because of the nature of helium, the compression of same in a refrigeration compressor results in the generation of significantly higher temperatures. In order to prevent these temperatures from becoming excessive, it is necessary to circulate substantially greater quantities of oil to the various components than typically is necessary when other more common refrigerants are utilized and to supply oil to the compression chambers as well. In addition to the need for the circulation of large quantities of oil, it is also very important that substantially all oil be removed from the compressed helium before it is supplied to the refrigeration or cryogenic system.

In order to accommodate these special requirements for use of helium as a refrigerant, the compressor of the present invention incorporates a generally radially extending passage 64 in the end plate of orbiting scroll member 14. Passage 64 at its inner end opens into the chamber defined by hub 66 provided on orbiting scroll member 14 in which bushing 38 and eccentric pin 36 are disposed. The outer end of passage 64 is plugged and an axially extending passage 68 extends upwardly therefrom and opens into the flow of suction gas entering the compression pockets of the compressor. Passages 64 and 68 thus serve to direct a portion of the oil being thrown out of the top of eccentric pin 36 to the suction gas flowing into the compression pockets.

Figure 2:
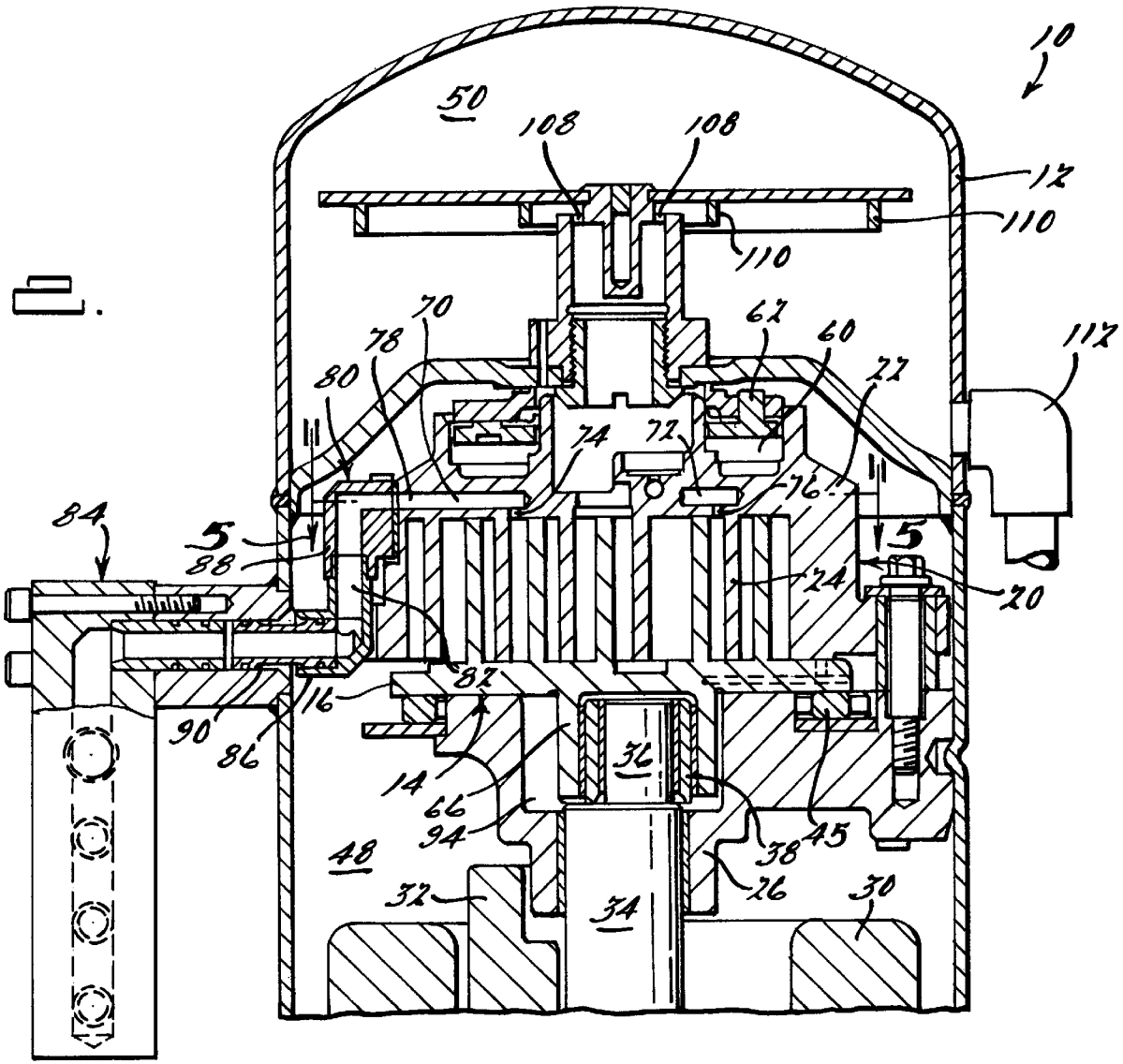
FIG. 2 is a fragmentary section view of the compressor of FIG. 1 showing the oil return and injection arrangement.
Figure 5:
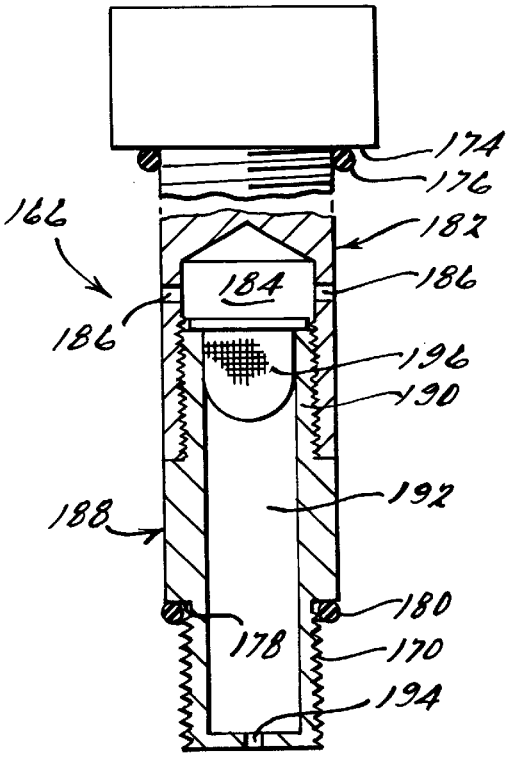
FIG. 5 is a section view of the non-orbiting scroll member forming a part of the compressor of FIG. 1, the section being taken along line 5—5 of FIG. 2.
Figure 5:
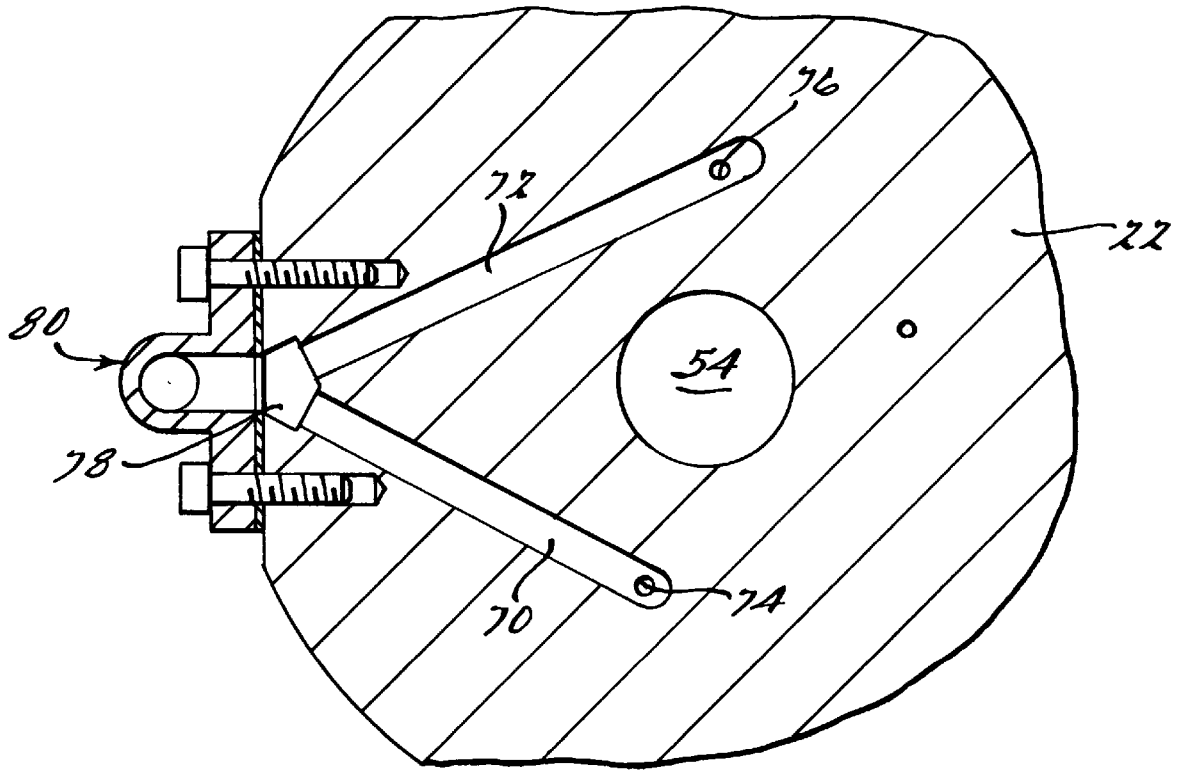

In addition to the supply of oil to the suction gas entering compressor 10, externally supplied oil is also injected into the fluid pockets during compression thereof. In order to accomplish this and as best seen with reference to FIGS. 2 and 5, end plate 22 of non-orbiting scroll member 20 is provided with a pair of generally chordally extending passages 70 and 72 the inner ends of which communicate with respective axial passages 74 and 76 opening into a pair of diametrically opposed fluid pockets which pockets are undergoing compression and hence at a pressure between suction and discharge. The outer ends of passages 70 and 72 merge into a single passage 78 which opens outwardly through a sidewall of the end plate 22 of non-orbiting scroll 20. A fitting 80 is secured to the sidewall of end plate 22 and defines a passage 82 leading from an oil inlet fitting 84 secured to outer shell 12 to passage 78. In order to accommodate axial movement of non-orbiting scroll member 20, fitting 80 is formed in two pieces with lower portion 86 being slidably telescopically received within the lower end of upper portion 88. Suitable sealing means such as an O-ring will preferably be provided between upper and lower portions 86 and 88. A relatively short tubular member 90 serves to sealingly interconnect oil inlet fitting 84 with lower portion 86 of fitting 80.

Figure 3:
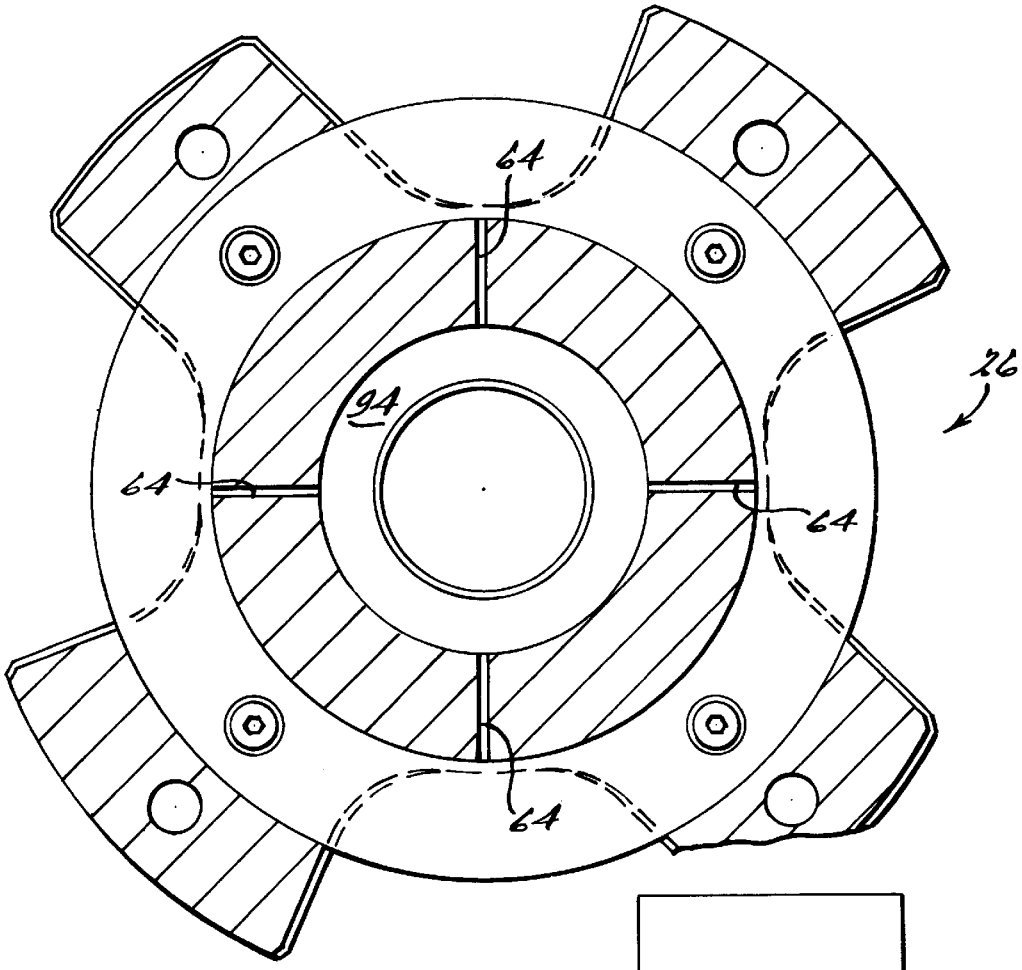
FIG. 3 is a section view of the main bearing housing of the compressor shown in FIG. 1, the section being taken along line 3—3 thereof.

In addition to the above, main bearing housing is provided with a plurality of generally radially extending passages 92 which serve to direct oil accumulating in recess 94 outwardly to Oldham coupling 45. As best seen with reference to FIG. 3, there will preferably be four such radially extending passages 92 positioned in substantially 90° spaced relationship to each other.

Discharge fitting 58 includes an upper tubular member 96 having a relatively large diameter threaded bore 98 opening inwardly from the lower end thereof and a depending locating flange portion 100 which is received within an opening 102 provided in muffler plate 46. A threaded flanged retainer 104 is received within bore 98 and serves to sealingly secure discharge fitting 58 to muffler plate 46 and to defame a flowpath for discharge gas from discharge passage 56 into discharge chamber 50.

Discharge fitting 58 supports an oil separator plate 106 secured to the upper end thereof in overlying relationship to outlet openings 108. Oil separator plate 106 extends radially outwardly from fitting 58 and includes a plurality of radially spaced annular depending flange portions 110 that serve to provide a tortuous flowpath for the discharge gas and thereby aid in separation of entrained oil.

Oil separated from the discharge gas by separator plate 106 will accumulate in the lower portion of discharge chamber 50. In order to recirculate this oil, an oil outlet fitting 112 is provided being secured to shell 12 so as to open into a lower portion of discharge chamber 50 which defames an upper oil sump. Oil from outlet fitting 112 is supplied to oil inlet fitting 84 as described in greater detail below.

In order to prevent excessive accumulation of oil in discharge chamber 50, a lubricant level oil return assembly 114 is provided which operates to return excessive oil to lower sump 42 through muffler plate 46. Oil return assembly 114 includes a through fitting 116 sealingly secured to and extending through muffler plate 46 adjacent an outer peripheral edge thereof from which a tube 118 extends to discharge fitting 58. Return fitting 116 defines a passage 128 extending therethrough which opens into the lower pressure suction chamber 48 via opening 130. If desired, a suitable filter may be provided within passage 128 to prevent any particles from being returned to the lower sump. Discharge fitting 58 includes a passage 120 extending axially downward from the upper end thereof and communicating at its lower end with a radially inwardly extending passage 122 via a restricted portion 124. The upper end of passage 120 is sealed off with a suitable plug 123. Tube 118 communicates with axially extending passage 120 via a second radially extending passage 126 located above radial passage 122.

As the oil level in discharge chamber rises, oil will flow into passage 122. Should the oil level rise above the lower edge of restrictor 124, oil will begin to flow through restrictor 124 into passage 120 and thence to passage 126, tube 118 through fitting 116 and be returned to the lower sump 42. It should be noted that because chamber 50 is at a pressure (discharge) greater than that of the pressure in chamber 48, oil will be forced through passage 122, restrictor 124, etc. and hence returned to lower sump 42 so long as the level 127 in discharge chamber 50 remains above the lower edge of restrictor 124. However, restrictor 124 will operate to limit the flow of compressed gas into suction chamber 48 during periods in which oil level 127 is below the lower edge of restrictor 124. It should also be noted that, if desired, plug 123 could be omitted thereby leaving passage 120 in open communication with the compressed gas in discharge chamber 50. In such case, it is necessary that restrictor 124 be located downstream of passage 120, i.e., in passage 126, tube 118 or through fitting 116. It should be noted that passage 120 will preferably be located substantially coaxial with the axial center of compressor 10. This will ensure that opening of restrictor 124 and/or passage 126 into passage 120 is in close proximity to the center axis 129 of the compressor and will greatly reduce the effect of tilting of compressor 10 on the level of oil retained in the discharge chamber 50.

Figure 4:
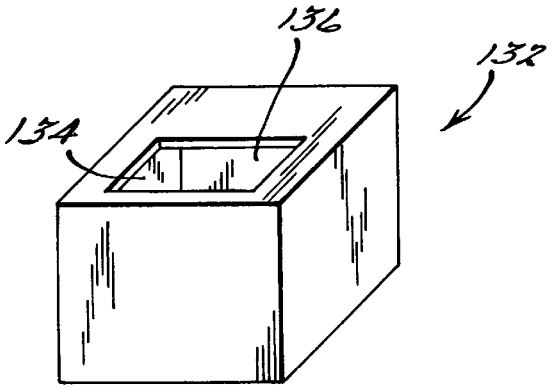
FIG. 4 is a perspective view of the discharge baffle incorporated in the compressor of FIG. 1.

In order to reduce the amount of oil entrained in the discharge gas that is carried over into discharge outlet 59 and also to resist large quantities of oil being expelled therethrough should compressor 10 be tilted so as to raise the oil level above the lower portion of discharge outlet 59, a baffle member 132 is secured to shell 12 in overlying relationship to the inner end of discharge outlet 59. As shown in FIG. 4, baffle member 132 may be in the form of a box having an opening 134 on the top sidewall thereof and an open end 136 which is sealingly secured to the inner surface of shell 12. Alternately, baffle member 132 may be cylindrical in shape with one end closed and opening 134 being oriented so as to face upwardly away from the upper surface of the lubricant in discharge chamber 50.

Referring now to FIG. 6, compressor 10 is shown incorporated in a refrigeration or cryogenic circuit specifically designed for use of helium as a refrigerant. As shown therein, compressed helium flows from compressor 10 via line 138 to a heat exchanger 140 which serves to separate oil therefrom. From heat exchanger 140, the compressed helium is routed serially through additional oil separators 142 to ensure substantially complete removal of entrained oil therefrom after which it is directed to a condenser 144 and then to additional system components (not shown) such as an evaporator and then returned to compressor 10 via line 141. Oil collected in discharge chamber 50 is directed from oil outlet 112 to a heat exchanger 146 via line 148 for cooling. Oil from heat exchanger 146 together with separated oil from heat exchanger 140 and oil separators 142 is then supplied to oil inlet fitting 84 via line 143 from which it is directed to the respective fluid pockets under compression. Because this oil is at substantially discharge pressure, oil will easily be caused to flow into the desired fluid pockets under compression which will be at a pressure above suction pressure but below discharge pressure. As shown, suitable check valves 150 are included at both discharge outlet 59 and oil outlet 112 to prevent undesired reverse flow of fluids. Additionally, lubricant separated in heat exchanger 140 as well as lubricant separators 142 will also be supplied to oil inlet fitting 84 via line 145 for injection into the moving fluid pockets. It should be noted that it is desirable that the pressure of the lubricant being returned to oil inlet fitting 84 from the various sources be at substantially the same pressure. Accordingly, suitably sized restrictors 147 are provided at the outlets of each of the oil separators 142 and heat exchangers 140 and 146.

As will now be appreciated, compressor 10 is designed to provide a high volume of oil flow to the compressor to both lubricate the various portions thereof as well as to ensure adequate cooling of the compressor. Additionally, compressor 10 includes an integral oil separator to aid in removal of the oil from the compressed refrigerant as well as to ensure an adequate supply of oil for injection into the compressor. Additionally, the provision for oil injection into the suction inlet provides insurance that the level of oil in the discharge chamber will be maintained whereas the overflow arrangement prevents this level from becoming excessively high.

Figure 7:
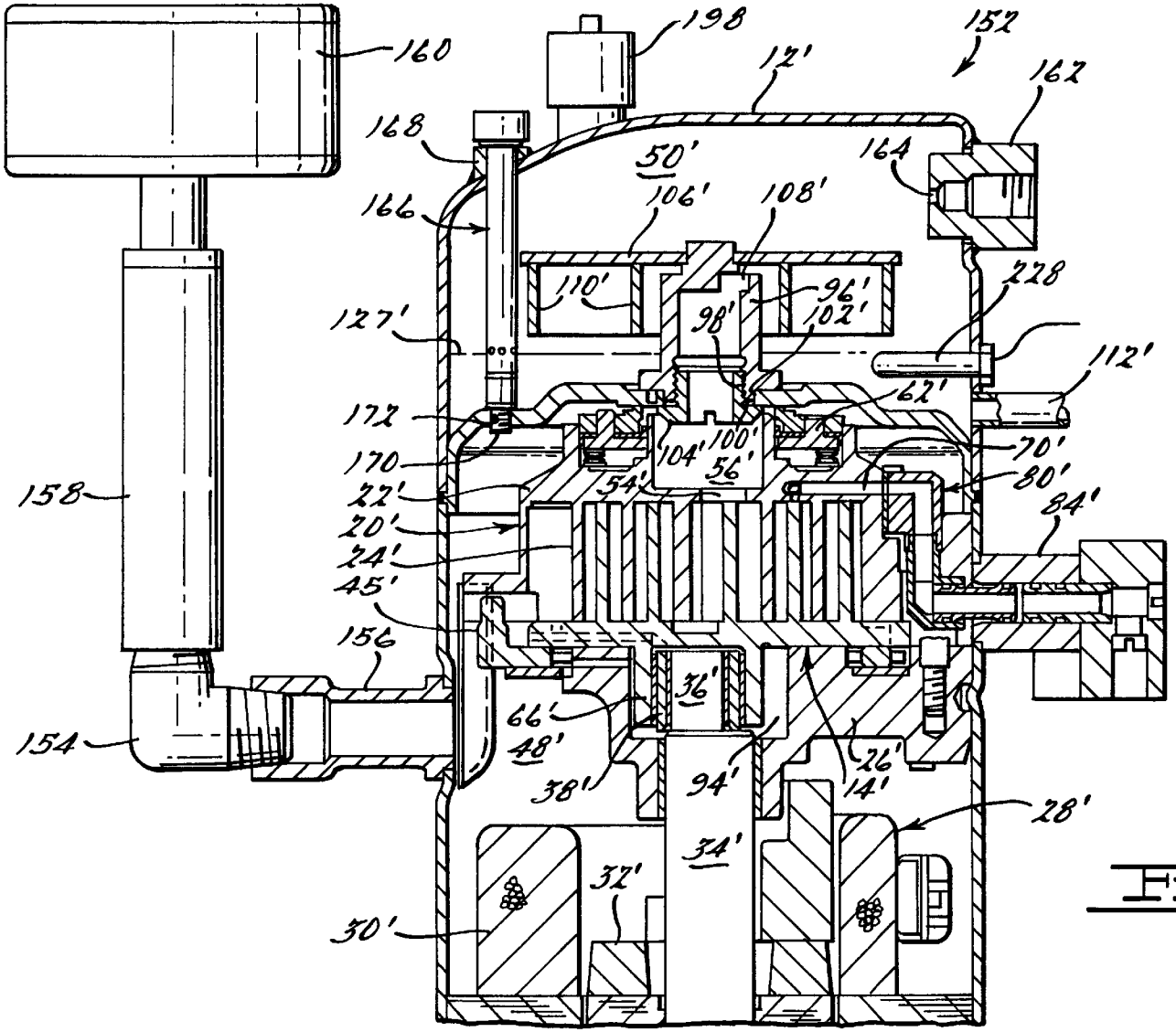
FIG. 7 is a section view similar to that of FIG. 2 but showing a hermetic scroll-type compressor specifically adapted for use as an air compressor all in accordance with the present invention.

Referring now to FIG. 7, a second embodiment of a compressor in accordance with the subject invention is disclosed which compressor is specifically adapted for use as an air compressor. Except as noted below, compressor 152 is substantially identical to compressor 10 including without limitation both the oil injection into the fluid pockets under compression, the injection of oil into the suction gas flowing to the compression pockets and the internal oil separator incorporated in compressor 10 as shown in FIG. 1. Accordingly, corresponding portions thereof have been indicated by the same reference numbers primed.

In place of the suction inlet 52 incorporated in compressor 10, compressor 152 includes an inlet assembly 154 which includes conduit 156 secured to the outer shell 12' which is adapted to receive a threaded connection for suction inlet conduit 158. A suction filter assembly 160, which may also include a muffler if desired, is secured to the other end of conduit 158 and serves to filter out particulate matter that could result in excessive wear as well as to muffle possible noise of the air being drawn into compressor 152.

Additionally, discharge fitting 162 of compressor 152 includes a restricted opening 164 at its inner end. Restricted opening 164 serves to restrict the flow of compressed air out of discharge chamber 50' which is particularly important during periods of compressor operation in which the back pressure loading is at zero or very low as this build up of discharge pressure in chamber 50' acts together with the intermediate pressure in biasing chamber 60' to bias the non orbiting scroll member 20' axially into sealing engagement with orbiting scroll member 14'. Additionally, in order to ensure sufficient biasing force on non-orbiting scroll member 20' to begin the compressing air on compressor start up as well as to ensure proper initial sealing between seal 62' and muffler plate 46', a plurality of springs are provided in biasing chamber 60' acting between a lower surface of seal 62' and the bottom surface of biasing chamber 60'.

It should be noted that the inclusion of restrictor 164 in discharge fitting 162 will not appreciably reduce system efficiency because during normal operation, the density of the compressed air flowing therethrough will be substantially greater than at low pressure operation.

Figure 8:
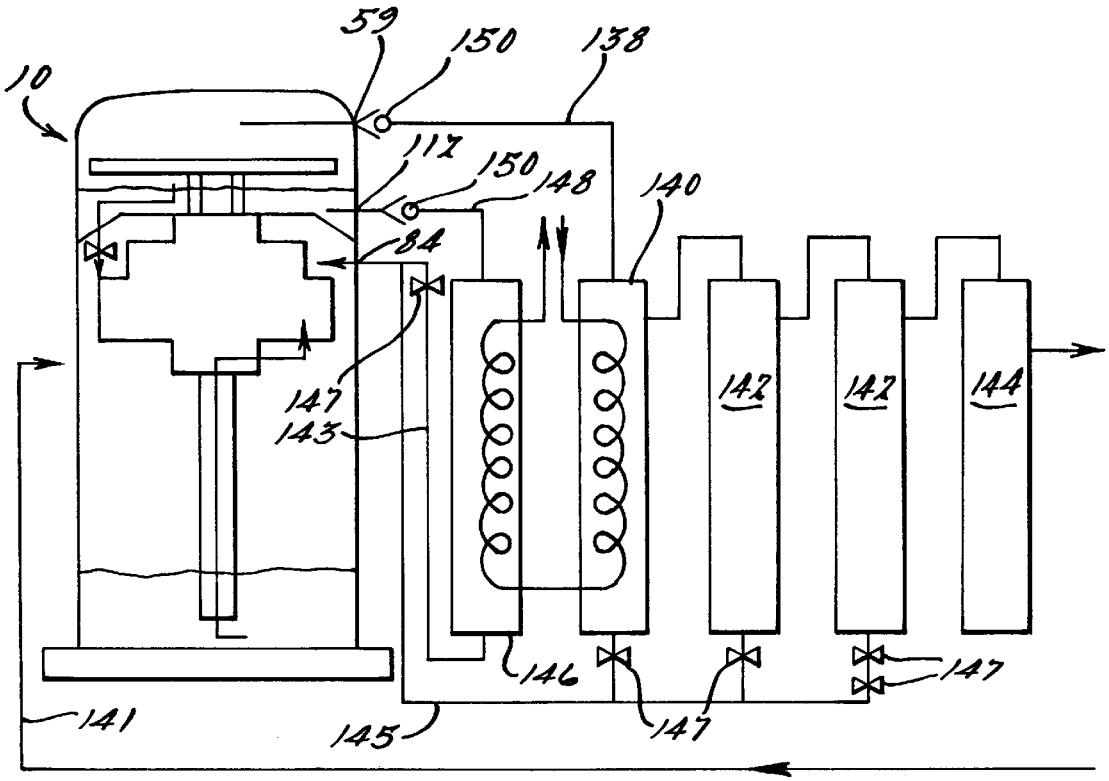
FIG. 8 is an enlarged fragmentary view of the removable oil return fitting incorporated in the compressor of FIG. 7.

In addition to the above, compressor 152 incorporates a modified arrangement for preventing accumulation of excessive oil in the discharge chamber. As best seen with reference to FIGS. 7 and 8, compressor 152 includes an elongated member 166 extending axially inwardly through a suitable fitting 168 provided on the top portion of outer shell 12' and having a lower end 170 threadedly received in a threaded opening 172 provided in muffler plate 46'. In order to prevent leakage through fitting 168 from discharge chamber 50', elongated member is provided with a shoulder 174 adjacent the upper end against which a suitable O-ring 176 is seated. Similarly, in order to prevent leakage through opening 172 in muffler plate 46', a second shoulder 178 is provided against which O-ring 180 is seated.

Elongated member 166 comprises an upper member 182 having an axially extending bore 184 provided therein and a plurality of circumferentially spaced radial bores 186 opening into bore 184 adjacent the upper end thereof. A lower member 188 is also provided having a reduced diameter portion 190 provided at the upper end thereof which is sized to be threadedly received in bore 184 of upper member 182. A central bore 192 extends axially from the upper end of lower member 188 forming a continuation of bore 184 and terminates adjacent the lower end where a restricted opening 194 is provided opening outwardly from the bottom of lower member 188. A suitable filter 196 is provided fitted in the upper end of lower member 188 and serves to filter any debris from oil being returned to the lower sump. Elongated member 166 is designed for easy removal and disassembly so as to enable periodic cleaning and/or replacement of filter 196. It should be noted that the distance from shoulder 178 to passages 186 will determine the oil level within discharge chamber 50'. Further, when the oil level is below passages 186, the restricted opening 194 will operate to limit the leakage of compressed air to the suction chamber.

Compressor 152 also incorporates a pressure relief valve 198 secured to outer shell 12' which is operative to vent discharge chamber 50' to atmosphere in response to an excessive pressure therein.

In addition to the above, compressor 152 includes a temperature sensor 228 extending into the oil sump provided in the lower portion of the discharge chamber 50'. Temperature sensor 228 is interconnected with the power supply to motor 28' and operates to deenergize same in response to an excessive temperature in the discharge chamber. It should be noted that while temperature sensor 228 is positioned so as to be immersed in the oil and hence will be primarily responsive to excessive oil temperature, it will also respond to excessive discharge gas temperature in the event the oil level drops below sensor 228.

Figure 9:
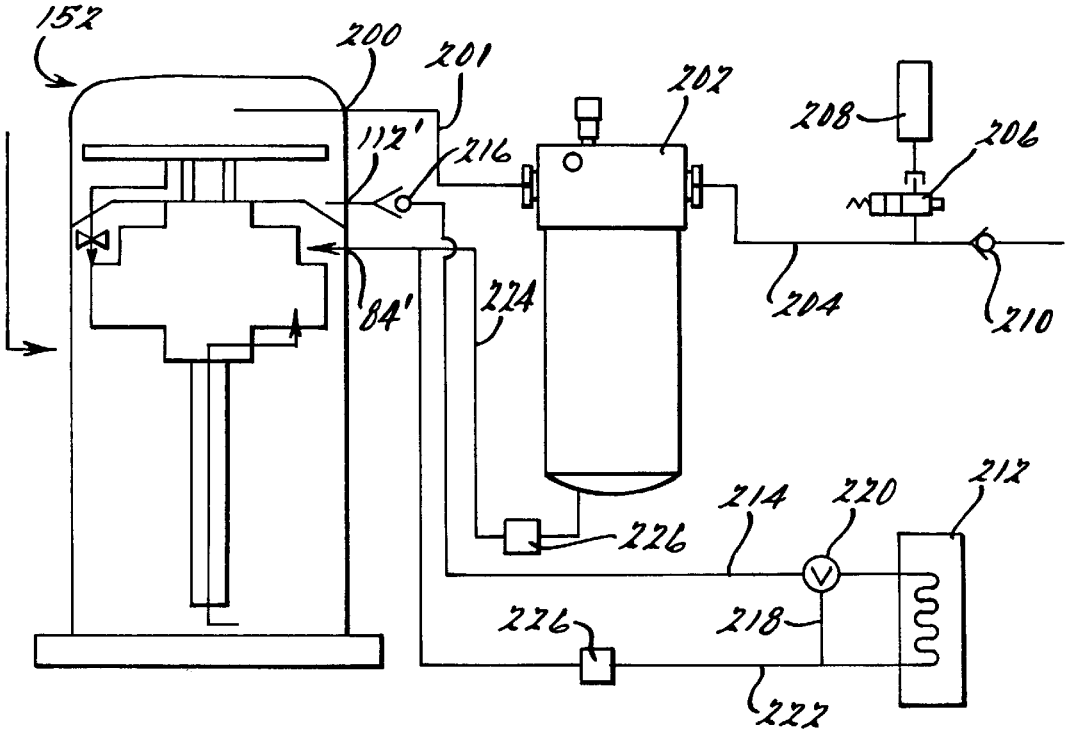
FIG. 9 is a schematic view similar to that of FIG. 6 but showing a fluid circuit incorporating the air compressor of FIG. 7.

Referring now to FIG. 9, a schematic of a compressor air and oil circulation circuit is shown incorporating compressor 152. Discharge outlet 162 of compressor 152 extends via line 200 to an oil separator 202 which operates to remove entrained oil from the compressed air. From oil separator 202, the compressed air is directed to a suitable storage tank (not shown) via line 204. A blow down valve 206 and associated silencer 208 is provided along line 204 and before a check valve 210 and serves to release any residual pressure in discharge chamber 50', oil separator 202 and lines 200 and 204 when compressor 152 is shut down. This pressure is vented to ensure that compressor 152 will not be required to start against a heavy pressure load that may exist. Preferably, blow down valve 206 will be a suitable solenoid actuated valve and check valve 210 will ensure that the tank or reservoir pressure is not vented.

Oil return outlet 112' is connected to a suitable oil cooler 212 via line 214. A check valve 216 is provided in line 214 adjacent outlet 112'. In order to prevent excessive cooling of the oil, a suitable bypass line 218 and associated valve 220 is provided which may operate to direct a portion or all of the oil directly to return line 222 thereby bypassing heat exchanger 212. Return line 222 extends back to oil injection inlet fitting 84' provided on compressor 152. Additionally, oil separated by oil separator 202 is also supplied to oil injection fitting 84' via line 224. In order to prevent debris entrained within the oil from being injected into the fluid pockets under compression, filters 226 are provided in both lines 222 and 224.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A scroll-type machine comprising:

an outer shell;

a first scroll member disposed within said shell and including a first end plate having a first spiral wrap provided thereon;

a second scroll member disposed within said shell and including a second end plate having a second spiral wrap provided thereon;

said second scroll member being supported for orbital movement relative to said first scroll member;

said first and second spiral wraps being intermeshed so as to define moving fluid pockets which decrease in size as they move from a radially outer position to a radially inner position;

a partition dividing said shell into a first chamber and a second chamber, said first chamber being at a pressure above that of said second chamber when said machine is operating, said first and second scroll members being positioned in said second chamber;

a lubricant sump disposed in said first chamber; and a level control disposed in said first chamber, said level control providing a continuous flowpath from said first chamber to said second chamber and being operative to direct lubricant therethrough to said second chamber in response to an increase in the level of lubricant above a predetermined level and to prevent lubricant from flowing therethrough to said second chamber when said level is below said predetermined level so as to thereby aid in maintaining a desired level of lubricant in said sump while resisting said level from rising above said predetermined level.

2. A scroll-type machine as set forth in claim 1 further comprising a flowpath for directing lubricant from said first chamber to said first and second scroll members.

3. A scroll-type machine as set forth in claim 2 wherein said flowpath directs said lubricant to said fluid pockets defined by said first and second scroll members when said fluid pockets are between said radially outer position and said radially inner position.

4. A scroll-type machine as set forth in claim 1 wherein said level control includes a flowpath defined in part by a member extending through said partition, said member including a passage extending therethrough.

5. A scroll-type machine as set forth in claim 4 wherein said passage in said member communicates with said first chamber at a position spaced from said partition.

6. A scroll-type machine as set forth in claim 5 wherein said scroll machine is a compressor, said fluid pockets being operative to compress a suction gas drawn from said second chamber and to discharge compressed gas into said first chamber and further comprising a lubricant separator in said first chamber operative to separate lubricant entrained in said compressed gas.

7. A scroll-type machine as set forth in claim 6 wherein said lubricant separator is supported in overlying relationship to a discharge port provided in said partition through which said compressed gas flows from said fluid pockets into said first chamber.

8. A scroll-type machine as set forth in claim 7 wherein said flowpath opens into said first chamber immediately adjacent a center axis of said compressor so as to minimize the effect of tilting of said compressor on said predetermined level.

9. A scroll-type machine as set forth in claim 8 wherein said shell includes a discharge outlet from said first chamber and a baffle member overlying said outlet.

10. A scroll-type machine as set forth in claim 9 wherein said baffle member is secured to said shell in surrounding relationship to said outlet and includes an opening facing away from said lubricant sump.

11. A scroll-type machine as set forth in claim 7 wherein said lubricant separator includes an elongated fitting having one end secured within an opening provided in said partition, said fitting having a first axial passage extending therethrough, one end of said passage opening into said first chamber and for receiving compressed gas from said compressor and the opposite end opening into said first chamber, and a separating plate overlying said opposite end.

12. A scroll-type machine as set forth in claim 11 wherein said separating plate includes a plurality of depending radially spaced annular flange members.

13. A scroll-type machine as set forth in claim 11 wherein said liquid control flowpath further comprises a second axially extending passage in said fitting, a first radial passage opening into said second axial passage and a second radial passage opening into said second axial passage above said first radial passage, said second radial passage is connected to said passage in said member.

14. A scroll-type machine as set forth in claim 13 further comprising a restriction in one of said first radial passage, said second radial passage and said passage in said member.

15. A scroll-type machine as set forth in claim 14 wherein said second axially extending passage is closed off at both ends thereof.

16. A scroll-type machine as set forth in claim 4 wherein said member of said level control includes a filter.

17. A scroll-type machine as set forth in claim 4 wherein said member extends through said shell and is removable from said scroll machine.

18. A scroll-type machine as set forth in claim 17 wherein said member includes a plurality of radially extending second passages opening into said passage, said radial passages being axially spaced from said partition.

19. A scroll-type compressor comprising:

an outer shell;

a first scroll member disposed in said shell and including a first end plate having a first upstanding spiral wrap provided thereon;

a second scroll member disposed in said shell and including a second end plate having a second upstanding spiral wrap provided thereon, said second spiral wrap being intermeshed with said first spiral wrap;

a stationary body disposed within said shell, said stationary body supporting said second scroll member for orbital movement with respect to said first scroll member whereby said first and second scroll members cooperate to define moving fluid pockets which decrease in size as they travel from the radially outer ends of said first and second wraps to the radial inner ends of said first and second wraps, said stationary body including a bearing;

a suction inlet in said shell for supplying suction gas to said first and second scroll members;

a discharge port centrally located on said first scroll member for discharging fluid compressed by said first and second scroll members;

a drive shaft rotatably supported by said bearing and drivingly connected to said second scroll member;

a partition disposed in said shell and cooperating therewith to partition said shell into a discharge chamber and a suction chamber, said partition including a discharge passage therethrough sealingly communicating with said discharge port whereby compressed gas discharged through said discharge port is directed to said discharge chamber;

a low pressure lubricant sump in said suction chamber;

a high pressure lubricant sump in said discharge chamber;

a lubricant flowpath for supplying oil from said high pressure sump to said moving fluid pockets intermediate the radially inner and outer ends of said first and second wraps;

a level control assembly for directing accumulations of lubricant in said high pressure sump above a predetermined level to said low pressure sump; and a lubricant pump for supplying lubricant from said low pressure sump to said suction gas being supplied to said first and second scroll members.

20. A scroll-type compressor as set forth in claim 19 further comprising an oil separator supported in said discharge chamber, said oil separator providing a tortuous flowpath for said discharge gas to thereby separate entrained lubricant therefrom.

21. A scroll-type compressor as set forth in claim 19 wherein said lubricant flowpath includes radially extending passages in said first end plate.

22. A scroll-type compressor as set forth in claim 21 wherein said lubricant flowpath includes a lubricant outlet fitting provided in said shell, a heat exchanger located externally of said shell and a lubricant inlet opening extending into said suction chamber and in fluid communication with said passages in said first scroll member.

23. A scroll-type compressor as set forth in claim 19 wherein said level control assembly includes a portion secured to said partition.

24. A scroll-type compressor as set forth in claim 23 wherein said level control assembly includes a portion extending outwardly from said shell whereby said level control assembly may be removed from said compressor.

25. A scroll-type compressor as set forth in claim 24 wherein said compressor is an air compressor.

26. A scroll-type compressor as set forth in claim 19 further comprising a temperature responsive sensor disposed within said high pressure sump, said temperature responsive sensor being operative to deenergize said compressor in response to a sensed excessive temperature in said discharge chamber.

27. A scroll-type compressor as set forth in claim 19 wherein said shell includes a discharge fitting opening into said discharge chamber, said fitting including a restrictor for restricting the flow of discharge gas from said shell.

28. A scroll-type compressor as set forth in claim 27 wherein said discharge gas exerts a biasing force to urge one of said first and second scroll members into sealing engagement with the other.

29. A scroll-type machine comprising:

a first scroll member including a first end plate having a first spiral wrap provided thereon;

a second scroll member including a second end plate having a second spiral wrap provided thereon, said second spiral wrap being intermeshed with said first spiral wrap;

a stationary body having a surface supporting said second scroll member for relative orbital movement with respect to said first scroll member whereby said first and second scroll members define moving fluid pockets;

an Oldham coupling supported on said stationary body radially outwardly of said surface supporting said second scroll and operative to prevent relative rotational movement between said first and second scroll members;

a drive shaft rotatably supported by a first bearing in said stationary body, said drive shaft being drivenly connected to said orbiting scroll member through a second bearing;

a lubricant supply for supplying lubricant to said first and second bearings; and passages in said stationary body for supplying lubricant from one of said first and second bearings to said Oldham coupling, said passages opening radially outwardly around the outer periphery of said stationary body.

30. A scroll-type machine as set forth in claim 29 further comprising passage means in said end plate of said orbiting scroll member for supplying lubricant from said lubricant supply to fluid flowing into said moving fluid pockets.

31. A scroll-type machine as set forth in claim 29 wherein said scroll machine is a compressor and further comprising an outer shell having a partition dividing said shell into a suction chamber and a discharge chamber, said first and second scroll members, said stationary body, said Oldham coupling, said drive shaft and said lubricant supply being disposed in said suction chamber, compressed fluid from said moving fluid pockets being discharged into said discharge chamber, a lubricant separator disposed in said discharge chamber and operative to separate lubricant from said compressed fluid, and a fluid flowpath for conducting said separated lubricant from said discharge chamber to said moving fluid pockets.

32. A scroll-type machine as set forth in claim 31 further comprising a level control providing communication between said discharge chamber and said suction chamber, said level control being operative to resist the level of said separated lubricant in said discharge chamber from exceeding a predetermined level.

33. A compressor comprising:

an enclosed shell;

a compressing mechanism disposed within said shell;

a low pressure lubricant sump in said shell;

a high pressure lubricant sump in said shell;

a lubricant flowpath for supplying oil from said high pressure sump to said compressing mechanism without circulating said oil through said low pressure sump; and a level control assembly for directing accumulations of lubricant maintained in said high pressure sump above a predetermined level to said low pressure sump.

34. A compressor as set forth in claim 33 further comprising a lubricant pump for supplying lubricant from said low pressure sump to said high pressure sump.

35. A compressor as set forth in claim 33 further comprising a partition disposed in said shell for partitioning said shell into a discharge chamber for receiving compressed gas and a suction chamber containing inlet suction gas, said low pressure sump being disposed in said suction chamber and said high pressure sump being disposed in said discharge chamber.

36. A compressor as set forth in claim 35 wherein said level control includes a flowpath defined in part by a member extending through said partition, said member including a passage extending therethrough.

37. A compressor as set forth in claim 36 wherein said passage in said member communicates with said discharge chamber at a position spaced from said partition.

38. A compressor as set forth in claim 36 wherein said member of said level control includes a filter.

39. A compressor as set forth in claim 36 wherein said member extends through said shell and is removable from said scroll machine.

40. A compressor as set forth in claim 37 wherein said flowpath opens into said discharge chamber in close proximity to a center axis of said compressor so as to minimize the effect of tilting of said compressor on said predetermined level.

41. A compressor as set forth in claim 35 further comprising a lubricant separator in said discharge chamber operative to separate lubricant entrained in said compressed gas.

42. A compressor as set forth in claim 41 wherein said lubricant separator is supported in overlying relationship to a discharge port provided in said partition through which said compressed gas flows from said fluid pockets into said first chamber.

43. A compressor as set forth in claim 41 wherein said compressor includes a second lubricant separator disposed in said shell.

44. A compressor as set forth in claim 43 wherein said shell includes a discharge outlet and said second lubricant separator comprises a baffle member overlying said outlet.

45. A compressor as set forth in claim 44 wherein said baffle member is secured to said shell in surrounding relationship to said outlet and includes an opening facing away from said high pressure sump.

46. A compressor as set forth in claim 41 wherein said lubricant separator includes an elongated fitting having one end secured within an opening provided in said partition, said fitting having a first axial passage extending therethrough, one end of said passage receiving compressed gas from said compressor and the opposite end opening into said discharge chamber, and a separating plate overlying said opposite end.

47. A compressor as set forth in claim 46 wherein said separating plate includes a plurality of depending radially spaced annular flange members.

48. A compressor as set forth in claim 41 wherein said level control assembly includes a flowpath defined in part by a member extending through said partition, said liquid control flowpath further comprising a second axially extending passage in said fitting, a first radial passage opening into said second axial passage and a second radial passage opening into said second axial passage above said first radial passage, said second radial passage is connected to said passage in said member.

49. A compressor as set forth in claim 48 further comprising a restriction in one of said first radial passage, said second radial passage and said passage in said member.

50. A compressor as set forth in claim 49 wherein said second axially extending passage is closed off at both ends thereof.

51. A compressor as set forth in claim 33 further comprising a temperature sensor disposed within said high pressure sump, said temperature sensor being operative to de-energize said compressor in response to an excessive temperature within said sump.

52. A compressor as set forth in claim 51 wherein said temperature sensor is normally positioned below the level of lubricant within said high pressure sump.

53. A compressor as set forth in claim 33 wherein said compressing mechanism is a scroll compressor and includes a first scroll member disposed within said shell and including a first end plate having a first spiral wrap thereon; a second scroll member disposed within said shell and including a second end plate having a second spiral wrap thereon; said scroll members being supported for orbital movement relative to one another; said first and second spiral wraps being intermeshed so as to define moving fluid pockets which decrease in size in response to said orbital movement to compress gas in said shell.

54. A compressor as set forth in claim 53 further comprising a flowpath for directing lubricant from said high pressure sump to said first and second scroll members.

55. A compressor as set forth in claim 54 wherein said flowpath directs said lubricant to said fluid pockets defined by said first and second scroll members when said fluid pockets are between a radially outer position and a radially inner position.

56. A compressor as set forth in claim 53 further comprising a lubricant pump operative to supply lubricant from said low pressure sump to said suction gas being supplied to said first and second scroll members.

57. A scroll-type gas compressor comprising:

an enclosed shell;

a first scroll member disposed within said shell and including a first end plate having a first spiral wrap thereon;

a second scroll member disposed within said shell and including a second end plate having a second spiral wrap thereon;

said scroll members being supported for orbital movement relative to one another;

said first and second spiral wraps being intermeshed so as to define moving fluid pockets which decrease in size in response to said orbital movement to compress gas;

a low pressure lubricant sump in said shell for supplying lubricant to said compressor;

a high pressure lubricant sump in said shell; and a temperature sensor disposed within said high pressure sump, said temperature sensor being operative to de-energize said compressor in response to an excessive temperature in said sump.

58. A scroll-type gas compressor as set forth in claim 57 wherein said temperature sensor is positioned below the normal level of lubricant in said high pressure sump.

59. A scroll-type gas compressor as set forth in claim 57 further comprising a lubricant flowpath for supplying lubricant from said low pressure sump to said high pressure sump to thereby replenish lubricant in said high pressure sump.

60. A scroll-type gas compressor as set forth in claim 59 further comprising a level control assembly for directing accumulations of lubricant in said high pressure sump above a predetermined level to said low pressure sump.

61. A scroll-type gas compressor as set forth in claim 60 wherein said lubricant flowpath directs lubricant to suction gas being drawn into said compressor.

62. A scroll-type gas compressor as set forth in claim 61 wherein said compressor includes an Oldham coupling and said lubricant flowpath also operates to supply lubricant from said low pressure sump to said Oldham coupling.

63. A scroll-type gas compressor as set forth in claim 61 wherein said high pressure lubricant sump is located in a discharge chamber, said discharge chamber receiving compressed gas from said moving fluid pockets, said compressor further comprising a lubricant separator disposed within said discharge chamber.

64. A scroll-type gas compressor as set forth in claim 63 further comprising a second lubricant separator disposed within said discharge chamber.

65. A scroll-type gas compressor as set forth in claim 60 wherein said level control assembly includes a flowpath for directing lubricant from said high pressure sump to said low pressure sump and further includes a filter disposed within said flowpath.

66. A scroll-type gas compressor as set forth in claim 65 wherein said filter is removable from outside said shell.

67. A scroll-type gas compressor as set forth in claim 57 further comprising a lubricant flowpath for supplying lubricant from said high pressure sump to said moving fluid pockets.

68. A scroll-type compressor comprising:

an enclosed shell;

a first scroll member disposed within said shell and including a first end plate having a first spiral wrap thereon;

a second scroll member disposed within said shell and including a second end plate having a second spiral wrap thereon;

said scroll members being supported for orbital movement relative to one another;

said first and second spiral wraps being intermeshed so as to define moving fluid pockets which decrease in size in response to said orbital movement to compress a gas in said shell;

a lubricant sump disposed in said shell;

a suction inlet through said shell for supplying suction gas to said scroll members;

a lubricant delivery system for delivering lubricant from said sump to said fluid pockets;

a first lubricant separator disposed within said shell, said lubricant separator being operative to separate lubricant from said compressed gas and return said separated lubricant to said sump; and a second lubricant separator disposed within said shell, said second lubricant separator being downstream from said first lubricant separator and operative to separate lubricant from said compressed gas and return said lubricant to said sump.

69. A scroll-type compressor as set forth in claim 68 further comprising a filter within said shell for filtering said lubricant.

70. A scroll-type compressor as set forth in claim 68 wherein said lubricant delivery system further operates to inject lubricant into said suction gas.

71. A scroll-type compressor as set forth in claim 70 further comprising a second lubricant sump, said lubricant injected into said suction gas being supplied from said second sump to thereby replenish said first lubricant sump.

72. A scroll-type compressor as set forth in claim 68 further comprising a temperature sensor in said sump, said temperature sensor being operative to de-energize said compressor in response to an excessive temperature in said sump.

73. A scroll-type air compressor comprising:

an enclosed shell;

a first scroll member disposed within said shell and including a first end plate having a first spiral wrap thereon;

a second scroll member disposed within said shell and including a second end plate having a second spiral wrap thereon;

said scroll members being supported for orbital movement relative to one another;

said first and second spiral wraps being intermeshed so as to define moving fluid pockets which decrease in size in response to said orbital movement to compress a gas in said shell;

a lubricant sump disposed in said shell;

a lubricant delivery system for delivering lubricant from said sump to said fluid pockets;

a lubricant separator disposed within said shell, said lubricant separator being operative to separate lubricant from said compressed gas and return said separated lubricant to said sump; and a removable filter assembly for filtering said separated lubricant being returned to said sump, laid filter assembly including a portion extending inwardly through said shell.

74. A scroll-type air compressor as set forth in claim 73 wherein said lubricant delivery system further operates to inject lubricant into said suction gas.

75. A scroll-type air compressor as set forth in claim 74 further comprising a second lubricant sump, said lubricant injected into said suction gas being supplied from said second sump to thereby replenish said first lubricant sump.

76. A scroll-type air compressor as set forth in claim 73 wherein said filter is removable from outside said shell.

77. A scroll-type air compressor as set forth in claim 73 further comprising a second lubricant sump, said lubricant delivery system also delivering lubricant from said second sump to suction gas being supplied to said compressor.

78. A scroll-type air compressor as set forth in claim 77 further comprising a level control assembly providing a flowpath for delivering separated lubricant above a predetermined level from said sump to said second sump, said removable filter being in said flowpath.

79. A scroll-type air compressor as set forth in claim 78 wherein said second sump is a low pressure sump and said lubricant sump is a high pressure sump.

80. A scroll-type air compressor as set forth in claim 79 further comprising a temperature sensor in said high pressure sump, said temperature sensor being operative to de-energize said compressor in response to an excessive temperature in said sump.

81. A scroll-type air compressor as set forth in claim 73 further comprising a stationary body supporting said first and second scroll members for relative movement, an Oldham coupling operative to prevent relative rotational movement between said first and second scroll members and said lubricant delivery system includes a passage in said stationary body for supplying lubricant to said Oldham coupling.

82. A scroll-type machine comprising:

a first scroll member including a first end plate having a first spiral wrap provided thereon;

a second scroll member including a second end plate having a second spiral wrap provided thereon, said second spiral wrap being intermeshed with said first spiral wrap;

a stationary body supporting said first and second scroll members for relative orbital movement whereby said first and second scroll members define moving fluid pockets;

an Oldham coupling operative to prevent relative rotational movement between said first and second scroll members;

a drive shaft rotatably supported by a first bearing in said stationary body for causing said orbital movement;

a lubricant supply for supplying lubricant to said first bearing; and passages in said stationary body for supplying lubricant to said Oldham coupling, said passage opening radially outwardly around the outer periphery of said stationary body.

83. A scroll-type air compressor as set forth in claim 73 wherein said removable filter is disposed within said shell.

84. A scroll-type air compressor as set forth in claim 83 wherein said lubricant sump is located in a lower portion of said shell and said lubricant separator is located in an upper portion of said shell, said removable filter being located in a return flow path from said separator to said sump.

85. A scroll-type air compressor as set forth in claim 73 wherein said removable filter is sealingly secured within an opening provided in said shell and extends into the interior thereof.

* * * * *

UNITED STATES PATENT AND TRADEMARK OFFICE

CERTIFICATE OF CORRECTION

PATENT NO. : 6,017,205

DATED : January 25, 2000

INVENTOR(S) : Roger C. Weatherston et al

It is certified that error appears in the above-identified patent and that said Letters Patent is hereby corrected as shown below:

On the Title Page, under U.S. Patent Documents, reference 4,676,075, "Shibayashi" should be -- Shiibayaski --.

On the Title Page, under U.S. Patent Documents, reference 5,593,294, "Houghby" should be -- Houghtby --.

Column 2, line 38, "defame" should be -- define --.

Column 4, line 49, "defames" should be -- defines --.

Column 15, line 25, "laid" should be -- said --.

Signed and Sealed this

Tenth Day of April, 2001

*Attest:*

Nicholas P. Godici

NICHOLAS P. GODICI

*Attesting Officer*

*Acting Director of the United States Patent and Trademark Office*